United States Patent [19]

Jensen

[11] Patent Number: 4,579,308

[45] Date of Patent: Apr. 1, 1986

[54] WALL STRUCTURE HAVING PLURAL SPACED PANELS

[75] Inventor: Gary Jensen, Drexel Hill, Pa.

[73] Assignee: DCA Incorporated, Warrington, Pa.

[21] Appl. No.: 700,437

[22] Filed: Feb. 11, 1985

[51] Int. Cl.[4] ..... A47F 5/08

[52] U.S. Cl. ..... 248/225.1; 52/36; 211/87; 211/189; 40/16; 248/222.2

[58] Field of Search ..... 211/87, 94, 189, 90; 40/16, 16.2, 16.4; 248/241, 225.1, 220.2, 222.2; 52/36, 588

[56] References Cited

U.S. PATENT DOCUMENTS

| | | | |
|---|---|---|---|
| 3,604,669 | 9/1971 | Asher | 248/915 X |
| 4,194,636 | 3/1980 | Byram | 211/94 X |
| 4,420,087 | 12/1983 | Johns | 211/189 |
| 4,450,970 | 5/1984 | Shepherd | 211/189 |

FOREIGN PATENT DOCUMENTS

| | | | |
|---|---|---|---|
| 1509668 | 1/1968 | France | 40/16 |
| 2450582 | 11/1980 | France | 211/94 |

*Primary Examiner*—Robert W. Gibson, Jr.

*Attorney, Agent, or Firm*—Seidel, Gonda, Goldhammer & Abbott

[57] ABSTRACT

A wall is comprised of a plurality of parallel panels attached to a common support and spaced apart to define a slot therebetween for receiving a portion of a hanger. Each panel is a metal extrusion with a recessed central portion and a discrete substrate removably attached to the panels. Each panel central portion has a U-shaped channel with threads on opposite walls of the channel to facilitate coupling of the panels to the common support.

9 Claims, 5 Drawing Figures

FIG. 3
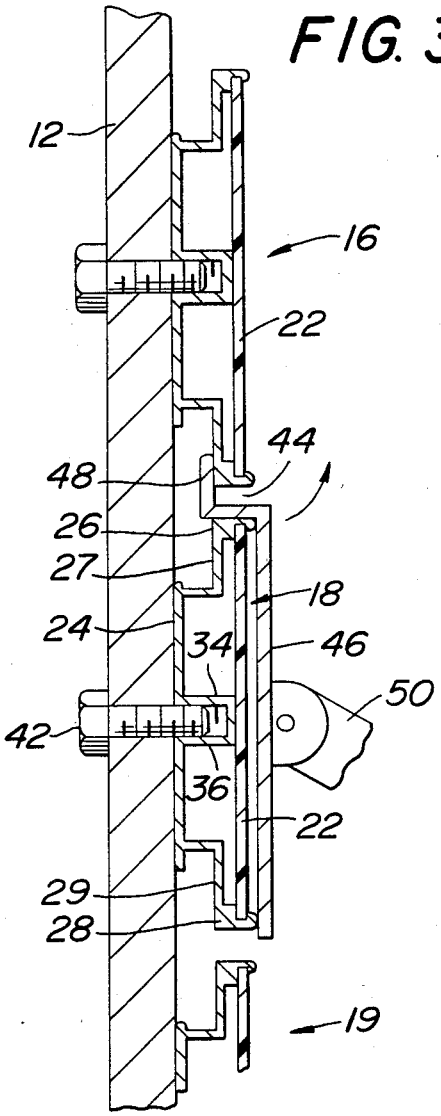
FIG. 4
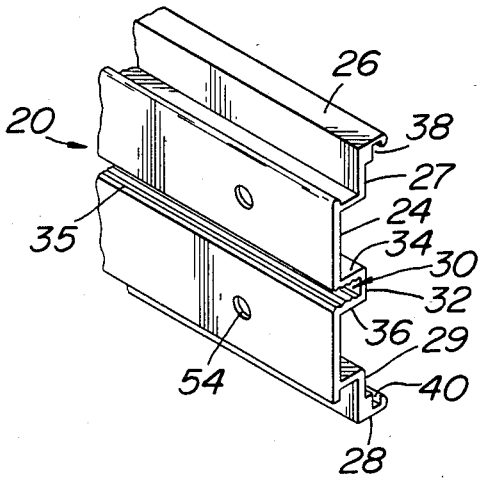
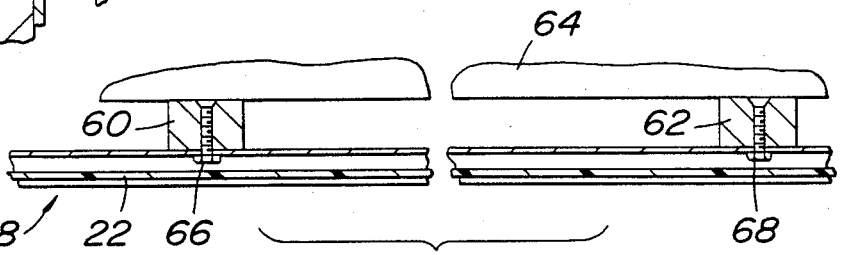
FIG. 5

WALL STRUCTURE HAVING PLURAL SPACED PANELS

BACKGROUND

Wall structure is defined by a plurality of spaced panels and which are adapted to display goods are known. There is a need for wall panels constructed in a manner so as to provide more versatility in use.

SUMMARY OF THE INVENTION

The present invention is directed to a wall structure having a plurality of parallel panels attached to a common support and spaced apart to define a slot therebetween for receiving a portion of a hanger. The wall structure is adapted for use in displaying goods in a retail establishment or at a trade show. Each panel is a metal extrusion with a recessed central portion and has a discrete substrate removably attached to the side edge portions so as to overlie the recessed central portion. Each central portion of a panel has a U-shaped channel. Each channel has an end wall adjacent its associated substrate and has generally parallel side walls. The channel side walls have threads along their length for receiving a threaded fastener at any location therealong.

It is an object of the present invention to provide a wall structure having plural spaced panels which is more versatile than those proposed heretofore while being more convenient for attaching to a common support and being capable of supporting display items having a larger weight.

Other objects and advantages will appear hereinafter.

For the purpose of illustrating the invention, there is shown in the drawings a form which is presently preferred; it being understood, however, that this invention is not limited to the precise arrangements and instrumentalities shown.

FIG. 3 is a sectional view taken along the line 3—3 in FIG. 2 but on an enlarged scale.

FIG. 4 is a partial rear perspective view of a panel.

FIG. 5 is a sectional view of an alternative common support.

DETAILED DESCRIPTION

Figure 1:
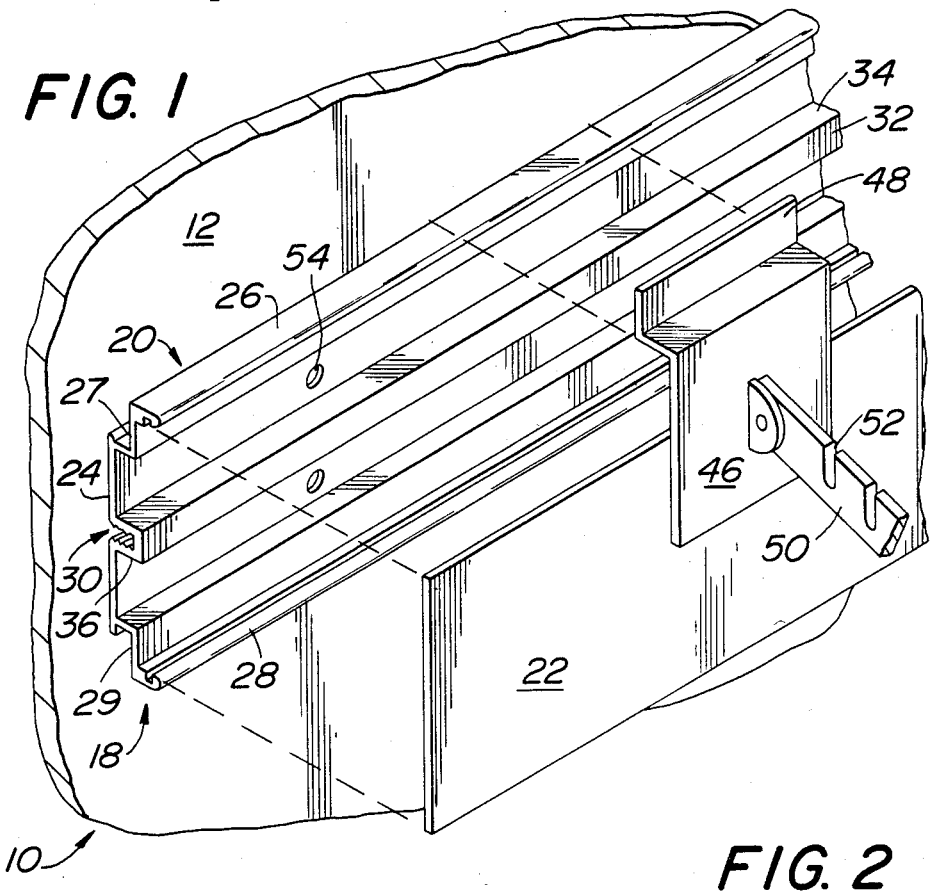
FIG. 1 is an exploded view of a panel in association with a common support.
Figure 2:
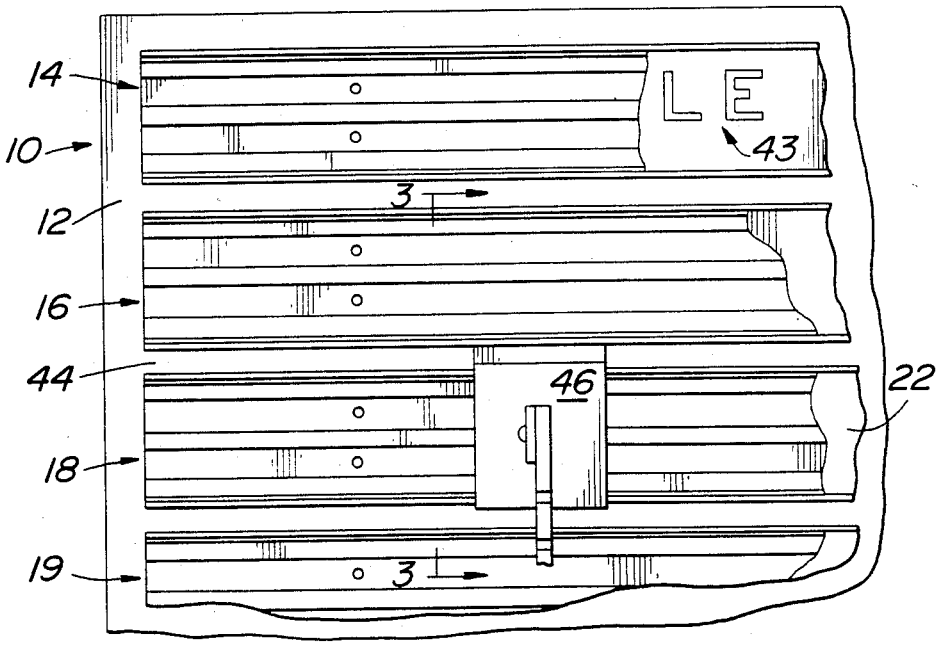
FIG. 2 is a partial front elevation view of a common support with a plurality of spaced parallel panels.

Referring to the drawing in detail, wherein like numerals indicate like elements, there is shown a wall structure in accordance with the present invention designated generally as 10. The wall structure 10 includes a support 12 such as a sheet of plywood or the like having a plurality of spaced parallel panels attached to one surface thereof and designated generally as 14, 16, 18 and 19. The wall panels are identical. Hence, only wall panel 18 will be described in detail.

The wall panel 18 is comprised of a rigid extrusion 20 and a removabe substrate 22 of the same length. Extrusion 20 is preferably extruded from a lightweight noncorosive metal such as aluminum so that it cannot be twisted more than 5° per 10 foot of length. The extrusion 20 includes a depressed center portion 24 connected to side edge portions 26 and 28 by walls 27 and 29 respectively. Walls 27 and 29 lie in a common plane.

The center portion 24 includes a U-shaped channel 30. Channel 30 is defined by end wall 32 and generally parallel side walls 34, 36. As shown more clearly in FIG. 3, wall 30 lies in a plane parallel to but spaced from the plane containing walls 27 and 29. Each of the side walls 34 and 36 have straight parallel threads 35 on juxtaposed surfaces. A fastener 42 may be threadedly engaged with the threads 35 at any location along the length of channel 30 for securing the panel 18 to the common support 12. See FIG. 3.

Side portion 26 has a notch 38 on an inner surface thereof. Side portion 28 has a similar notch 40. The notches 38 and 40 lie in a common plane so that the substrate 22 will extend therebetween and be supported in a central portion thereof by contact with the end wall 32. Substrate 22 is preferably made from a flexible polymeric plastic material so that it may be positioned in the notches 38, 40 from a front face of panel 18 or from an end face of the panel 18. One or more of the substrates 22 have a decorative surface which may include letterings 43 which may describe the articles to be supported from the wall, may include trademarks, may include informative information indicating that the articles supported thereon are on sale, etc. The substrates 22 may be of different decorative colors and may have printing thereon such as printing resembling a wood grain so as to simulate a piece of wood. Since the substrates 22 are easily removable from the front or an end of the panels, they may be changed as desired.

Typical dimensions for extrusion 20 are as follows: width of 2.625 inches, length of 8 feet, height of $\frac{1}{2}$ inch, with channel 30 dimensioned to receive a $\frac{1}{4}$ inch diameter fastener. Substrate 22 has a thickness of 0.060 inches.

Adjacent panels are spaced from one another. The space between panel 16 and 18 is designated 44 and is generally T-shaped as shown in FIG. 3. See FIG. 3. Space 44 is sufficient to removably accomodate a tongue 48 on a hanger 46. Tongue 48 is genrally L-shaped and may be inserted through space 44 to the position as shown in Fig. 3 whereby a side edge portion of the extrusion forming part of panel 16 resists the weight of articles supported by the hanger 46. Hanger 46 preferably has a bracket arm 50. Arm 50 may have one or more notches 52 to facilitate supporting a plurality of articles thereon. As shown more clearly in FIG. 3, the rear surface on hanger 46 contacts only the upper and lower ridges on the side portions 26 and 28 so that hanger 46 is parallel to the substrate 22 without contacting the substrate 22. Thus, the substrate 22 is prevented from being marred by the hangaer 46. The hanger arm 50 may assume a wide variety of configurations including a clamp-shape for embracing one end of an object to be displayed while a mating hanger embraces an opposite end portion of the object to be displayed.

The wall structure 10 is preferably a portable structure for use as a display in trade shows or in retail establishments. The present invention also lends itself for use in connection with permanent existing walls. See FIG. 5. Mounting strips 60 and 62 are parallel to one another and attached to a vertical wall 64 in any conveneient manner. Panels such as panel 18 are attached to the mounting strips by fasteners 66, 68. Fasteners 66, 68 extend through holes 54 in the depressed center portion of the panels. Hence, the panels may be utilized with different types of common supports including mounting strips. When the panels are utilized with mounting strips such as strips 60, 62, the threaded channels 30 are not used. It will be noted that the fasteners 66, 68 are applied from the front of the panel. Thereafter, the substrate 22 is attached either from the front or an end of the panels as described above.

For the purpose of illustrating the invention, there is shown in the drawings a form which is presently preferred; it being understood, however, that this invention is not limited to the precise arrangements and instrumentalities shown.

I claim:

1. A wall structure comprising a plurality of parallel panels attached to a common support and spaced apart to define a slot therebetween for receiving a portion of a hanger, each panel being a metal extrusion with a recessed central portion, a discrete substrate removably attached to side edge portions of said panels, each substrate overlying the recessed central portion of its associated panel, each panel central portion having a U-shaped channel on a rear face thereof, each channel having an end wall adjacent the substrate on its associated panel and generally parallel side walls, said channel side walls having threads along their length for receiving a threaded fastener at any location along their length.

2. A wall structure in accordance with claim 1 wherein said end wall engages a central portion of the associated substrate.

3. A wall structure in acordance with claim 1 wherein said substrates are attached to their extrusions in a removable manner from a front face of the extrusions.

4. A wall structure in accordance with claim 1 wherein said substrates are attached to their extrusions in a removable manner from an end of the extrusions.

5. A wall structure in accordance with claim 1 wherein an exposed surface of the substrates is decoratively printed.

6. A wall structure comprising a plurality of parallel panels attached to a common support and spaced apart to define a slot therebetween for receiving a portion of a hanger, each panel being an extrusion with a recessed central portion between side edge portions, each side edge portion having a slot on an inner surface thereof, a discrete substrate removably disposed in said slots on each panel, each substrate having a length corresponding to the length of its associated panel and overlying the recessed central portion of its associated panel, each panel central portion having a U-shaped channel on a rear surface thereof, each channel having an end wall adjacent to a substrate on its associated panel and side walls generally perpendicular to its associated substrate, said side walls having threads along their length for receiving a threaded fastener at any location along their length to facilitate attachment of the panels to the common support.

7. A wall structure in accordance with claim 6 wherein each extrusion has co-extensive walls on opposite sides of said channel lying in a first plane and a second set of co-extensive walls lying in a plane closer to the substrate associated therewith.

8. A wall in accordance with claim 6 wherein said common support is a sheet of laminated materials at least one of which is wood.

9. A wall structure in accordance with claim 7 wherein said common support includes a plurality of parallel mounting strips, said walls in said first plane having holes, at least one fastener joining each panel to said strips via said holes.

* * * * *